US012721427B2

(12) United States Patent
Heatherwick et al.

(10) Patent No.: US 12,721,427 B2
(45) Date of Patent: Sep. 1, 2026

(54) ACCESS TABLE SYSTEM

(71) Applicant: AC Art LLC, New York, NY (US)

(72) Inventors: Thomas Heatherwick, London (GB); Stuart Wood, London (GB)

(73) Assignee: AC ART LLC, New York, NY (US)

( * ) Notice: Subject to any disclaimer, the term of this patent is extended or adjusted under 35 U.S.C. 154(b) by 227 days.

(21) Appl. No.: 18/385,420

(22) Filed: Oct. 31, 2023

(65) Prior Publication Data

US 2025/0134246 A1 May 1, 2025

(51) Int. Cl.
*A63G 21/18* (2006.01)
*A47B 37/00* (2006.01)

(52) U.S. Cl.
CPC ..... *A47B 37/00* (2013.01); *A47B 2200/0035* (2013.01)

(58) Field of Classification Search
CPC ..... A63G 1/26; B65G 17/065–066; B65G 17/086
USPC ..... 472/36, 43
See application file for complete search history.

(56) References Cited

U.S. PATENT DOCUMENTS 2,089,592 A * 8/1937 Roy ..... B65G 17/086 198/840
2,157,283 A * 5/1939 Dyson ..... B65G 17/066 198/831
2,705,073 A * 3/1955 Muller ..... B65G 47/763 198/851
3,379,300 A * 4/1968 Ford ..... B65G 17/42 198/833
3,395,648 A * 8/1968 Ford ..... B66B 21/10 198/321
3,493,097 A * 2/1970 Ford ..... B65G 23/20 198/833
3,498,445 A * 3/1970 Piper ..... B66B 23/14 198/833
3,877,567 A * 4/1975 Sommerfield ..... B65G 17/066 198/833

(Continued)

FOREIGN PATENT DOCUMENTS

GB 621659 A 4/1949
WO 2018/002962 A1 1/2018

OTHER PUBLICATIONS

International Search Report and Written Opinion mailed Jun. 7, 2024, from PCT/US2023/036331, 14 sheets.

*Primary Examiner* — Joseph A Dillon, Jr.
(74) *Attorney, Agent, or Firm* — KATTEN MUCHIN ROSENMAN LLP

(57) ABSTRACT

Access table system of the disclosed invention provides automated social platform to make people easily connect to each other. The access table system also allows prompts/initiate multiple social interaction without leaving the seat. The access table system includes a track system including at least one guide track, scale members coupled to the track system, and a spine arranged along the scale members, and at least one driving mechanism to drive the scale members. The scale members includes scale platforms that provide spaces for people and objects. The scale platforms are connected each other in a tessellating fashion are configured to move in a direction. The access table system can be operated in varied speed to create various uses, such as public/formal dinner/performance/lecture/concert event.

20 Claims, 9 Drawing Sheets

(56) References Cited

U.S. PATENT DOCUMENTS

| | | | | | |
|---|---|---|---|---|---|
| 4,944,552 | A * | 7/1990 | Harris | B64D 11/0638 | 297/145 |
| 5,042,648 | A * | 8/1991 | Garvey | B65G 17/066 | 198/833 |
| 5,394,978 | A * | 3/1995 | Majewski, Sr. | B65G 23/16 | 198/833 |
| 5,527,221 | A * | 6/1996 | Brown | A63G 21/08 | 472/36 |
| 5,894,918 | A * | 4/1999 | Bonnet | B65G 47/82 | 198/833 |
| 6,016,901 | A | 1/2000 | Soot | | |
| 6,334,526 | B1 * | 1/2002 | Hatton | B65G 17/066 | 198/469.1 |
| 6,640,957 | B2 * | 11/2003 | Fargo | B66B 23/02 | 198/321 |
| 7,090,069 | B2 * | 8/2006 | Kawasaki | B65G 21/2063 | 198/494 |
| 7,588,140 | B2 * | 9/2009 | van den Goor | B65G 17/066 | 198/833 |
| 8,297,204 | B1 * | 10/2012 | Giannoccora | A47B 13/081 | 108/42 |
| 8,973,737 | B2 * | 3/2015 | Yamaguchi | B65G 17/42 | 198/474.1 |
| 9,174,803 | B2 * | 11/2015 | Cleaves | B65G 17/068 | |
| 9,394,112 | B2 * | 7/2016 | Andreoli | B65G 17/385 | |
| 9,938,732 | B1 * | 4/2018 | Hay, Jr. | E04G 1/24 | |
| 12,179,123 | B2 * | 12/2024 | Laffin | A63G 7/00 | |
| 2007/0062421 | A1 * | 3/2007 | Sherman | A47B 13/088 | 108/64 |
| 2018/0327186 | A1 * | 11/2018 | Maeder | B65G 17/065 | |

* cited by examiner

ACCESS TABLE SYSTEM

BACKGROUND

In social events in which many guests are invited for dinner, group discussion or some other purposes, a group of attendees usually sit at separate tables. This conventional way of gathering generally provides limited social interactions and prevents broad interactions with the other gathering attendants, in particular when there are a large number of people gathering in a place. Standard seated gathering only allows people to socialize with people seated close to them. However, there are situations which require the attendees to actively interact with each other. In the conventional way of seating, people need to move around the room in order to broadly interact with the others. However, moving around in a room is not always easy for some environment such as dinner gathering. For events such as performance and concert, once people are seated, they May stay there during the performance and may not have an opportunity to watch the performance in various perspective.

SUMMARY

In order to overcome the disadvantages and issues of the conventional way of gatherings, the disclosed invention provides a system that allows gathering attendants to more broadly and easily interact with the other attendants. The access table system of the disclosed invention is a social device to make people easily connect to each other. The access table system provides an automated social platform where individuals are exposed to a large number of people to start conversations with, allows people to meet many different people at one event, and removes significant barriers to initiating a conversation with a stranger. The access table system also allows prompts/initiate multiple social interaction without leaving the seat. For performance events, the access table system allows audience to move around the central area, view from different angles and experience different viewpoints without leaving their seats.

Unlike baggage carousels in airports and sushi delivery systems in Japanese restaurants, the access table system is configured to move people with an articulating table/platform that engineers movement of people around a central spine at various speed, and is configured to operate with smooth and simultaneous movement. Moving conveyor mechanisms of the access table system supports seated social engagement and static table provides proximity for conversations.

These advantages and others are achieved, for example, by an access table system that comprises a track system including at least one guide track forming a loop, a plurality of scale members coupled to the track system, a spine arranged along the scale members and including a vertical member and a horizontal member formed at a top portion of the vertical member, and at least one driving mechanism configured to drive the scale members along the guide track. The loop comprises at least one parallel region in which sections of the guide track are aligned substantially in parallel. The scale members are connected to each other and are configured to be movable along the guide track. Each scale member comprises a scale platform, a wheel system that comprises at least one guide wheel configured to be coupled to the at least one guide track, and a link unit configured to link the scale platform to a scale platform of an adjacent scale member. In the parallel region, the spine is disposed between the scale members that are parallel to each other and are at opposite sides.

The access table system may further comprise a base deck covering the track system. The base deck has an opening through which the scale platforms of the scale members are exposed. The base deck may include a space through which users access the scale platforms. The loop May comprise one or more diverge regions in which the guide track are not in parallel, and the base deck may include one or more counter units in the diverge regions. The link unit may comprise a link assembly mounted on a lower surface of the scale platform. The link unit may further comprise a linking rod connecting the scale platform to a scale platform of the adjacent scale member. The linking rod is rotatably coupled to the link assembly and to a link assembly of the adjacent scale member.

In an embodiment, the link assembly may further comprise a first axle and a second axle, and the linking rod is configured to be rotatably coupled to the first axle of the scale member and configured to be rotatably coupled to the second axle of the adjacent scale member. In another embodiment, the link assembly may comprises an axle, and the linking rod is configured to be rotatably coupled to the axle of the scale member and to the axle of the adjacent scale member.

BRIEF DESCRIPTION OF THE DRAWINGS

The preferred embodiments described herein and illustrated by the drawings hereinafter are to illustrate and not to limit the invention, where like designations denote like elements.

DETAILED DESCRIPTION

Figure 1A:
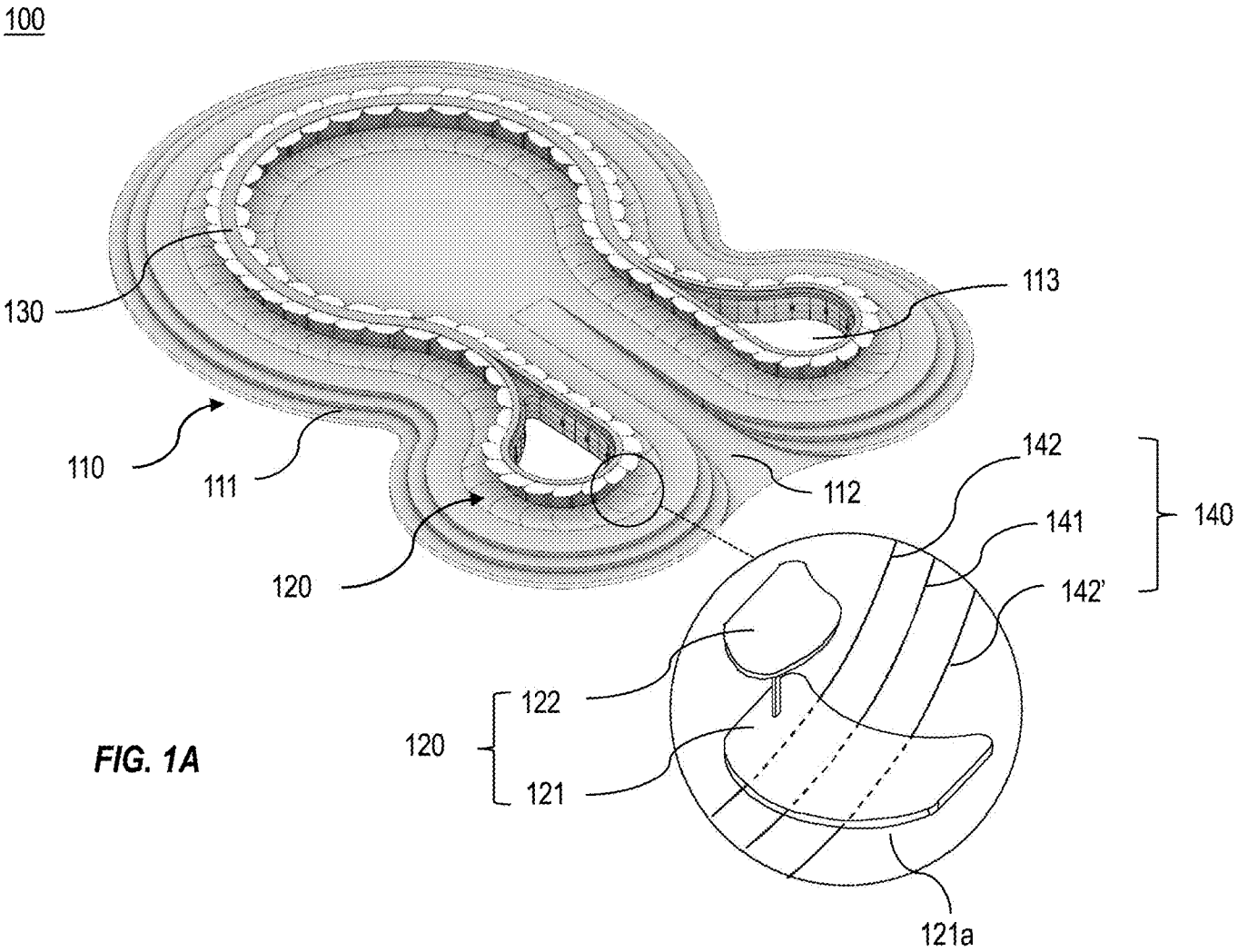
FIG. 1A shows a perspective view of the access table system of the disclosed invention.

In this section, some embodiments of the invention will be described more fully with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments. Parts that are the same or similar in the drawings have the same numbers and descriptions are usually not repeated.

As described above, the access table system of the disclosed invention is a social device configured to provide opportunity of social interaction and changing perspective. For these purposes, the access table system is configured based on ideas of a number of tables and seats coordinated through continuous moving mechanism that supports seated social engagement with comfort. The access table system includes mechanism that operates with smooth and simultaneous movement with no perceivable jolts, creating a platform for numerous face-to-face social interactions. The access table system can be operated in varied speed to create various uses, such as public/formal dinner/performance/lecture/concert event.

Figure 1B:
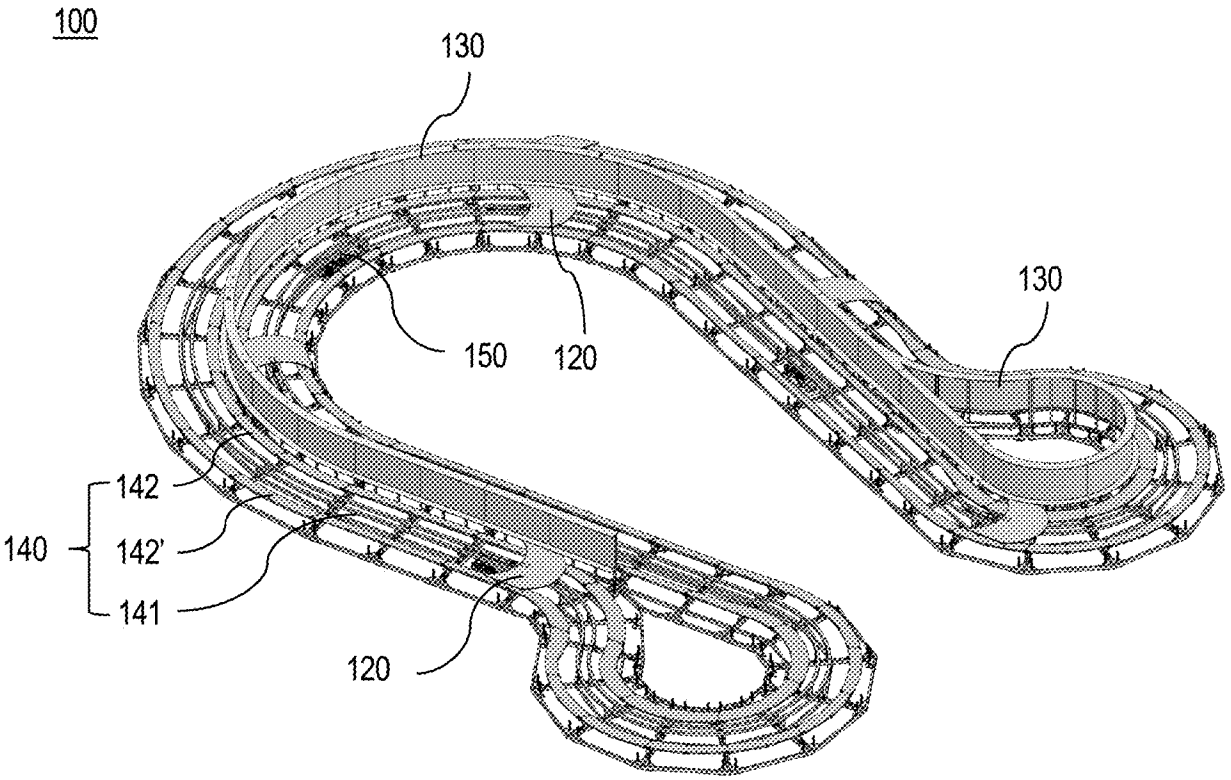
FIG. 1B shows a perspective view of an internal structure of the access table system shown in FIG. 1A.

With reference FIGS. 1A-1B, shown are diagrams illustrating access table system 100 of the disclosed invention. The access table system 100 is a kinetic structure resembles a slow moving carousel. A long dining table, for example, is split in half with one side moving one way while the other side moves in the other way. FIGS. 1A-1B exemplarily show a horseshoe shape access table system 100. However, the configuration of the access table system 100 is not limited to the horseshoe shape, and may have any other shapes and configurations. For example, the access table system 100 may have an oval shape or a dog bone shape with straight sections.

FIG. 1A shows a perspective view of the access table system 100. The access table system 100 includes base deck 110, a plurality of scale members 120 configured to move and accommodate people and/or objects, and fixed spine 130 placed between scale members 120 moving in opposite directions to each other. Each scale member 120 includes scale platform 121 and may include scale table 122 attached to the scale platform 121. FIG. 1B shows a perspective view of an internal structure of the access table system 100 under the base deck 110. The access table system 100 includes track system 140 that includes one or more tracks to guide movement of the scale members 120. The access table system 100 also includes one or more driving mechanisms 150 to drive the scale members 120 to move in a direction. The scale members 120 are configured to support at least the weight of a person. The track system 140 may be configured to be substantially flat without inclines.

The base deck 110 is a base structure that supports the scale members 120, track system 140, and spine 130. The base deck 110 also provide spaces and passages for people to access the scale members 120 and spaces for service areas such as bar counter unit 113. The base deck 110, for example, may include structural support (not shown), steps 111, accessible ramp 112 optionally with handrails, and recessed kitchen serving area or bar counter unit 113. The base deck 110 however may have different configurations and elements depending on intended utilities of the access table system. The base deck 110 covers the internal structure of the access table system 100.

Track system 140 and drive mechanisms 150 are embedded within the base deck 110 to guide and drive the scale members 120. The track system 140 includes guide track 141 that is located under the scale platform 121 and is coupled to the scale members 120 to guide movements of the scale members 120. As shown in FIG. 1B, the guide track 141 form a loop with curved and straight sections. The track system 140 may include one or more support tracks 142 that further support the scale members 120. FIGS. 1A-1B exemplarily shows two support tracks (rails) 142, 142' and one guide track 141 located at around center portion of the scale platform 121 between the support tracks 142, 142'. The access table system 100 however may have different configurations of the tracks based on applications.

The scale members 120 move along the guide track 141 in a tessellating, revolving fashion. The scale platforms 121 are placed above the track system 140, and each scale platform 121 is coupled to the guide track 141. The scale platforms 121 are tessellated with adjacent scale platforms to provide smooth movements, without any noticeable gaps between two scale platforms 121, in any of straight and curved sections of the tracks 140. The scale platforms 121 are linked to each other. Each scale member 120 includes a link unit 127 that includes a link assembly 123 mounted on a lower side 121*a* of the scale platform 121 and linking rod 124 that is coupled to link assemblies 123 of adjacent scale members (see FIGS. 5A-5C). Herein, the adjacent or neighboring scale member is defined as the next scale member at a forward or backward moving direction of the scale member. The base deck 110 may have an opening 114, and the scale platforms 121 may be exposed externally through the opening 114 (see FIG. 4B). Edge portions of the scale platforms 121 may be occluded by the base deck 110. In an embodiment, scale tables 122 may be attached to the scale platforms 121. The scale tables 122 may be tessellated with its neighbor scale tables. In this case, the scale table 122 is allowed to rotate within a certain angle to smoothly move in curved sections while being tessellated with each other. Objects such as chairs, stools, plant pots and/or additional other objects may be placed on the scale platform 121 based on intended utilities of the access table system 100. In an embodiment, some of the scale platforms 121 are supplied with chairs while the other scale platforms 121 are supplied with objects such as plant pots (see FIG. 9).

Figure 2:
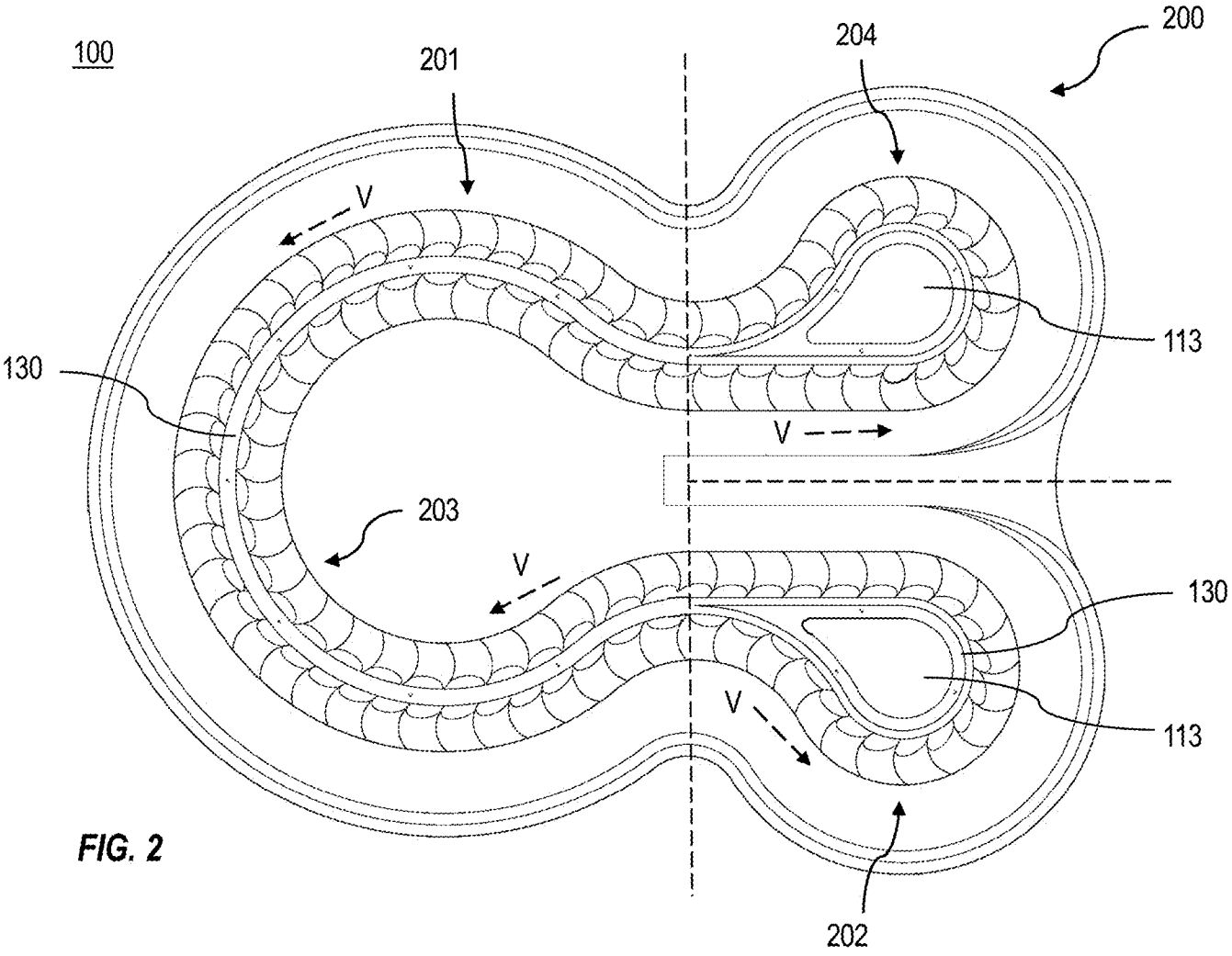
FIG. 2 shows a top view of the access table system.

With reference to FIG. 2, shown is a top view of the access table system 100. The tessellated scale members 120 form a loop 200 and may be driven to continuously move in a direction V at a constant speed. In the exemplary horseshoe shape configuration of the access table system 100 as shown in FIG. 2, the loop 200 may include parallel sections 201, 203 and diverge sections 202, 204. In the parallel sections 201, 203, the scale members 120 in the section 201 and scale members 120 in the section 203 are arranged close enough only separated by the spine 130 and are arranged to be substantially parallel to each other. Herein, being parallel is defined based on a tangential component of the moving direction V along the loop 200. Therefore, even in the curved sections of the loop 200, the facing scale members 120 in opposite sides (sections 201 and 203) continues to be substantially parallel to each other. In the horseshoe shape configuration, the scale members 120 in the sections 201 and 203 move opposite to each other. The portion of the loop 200 including parallel sections 201 and 203 is referred to as a parallel region of the loop 200. The portion of the loop 200 which has no parallel sections is referred to as a diverge region. The access table system 100 however may not have the diverge region depending on shapes, configurations and intended utilities of the access table system.

In an embodiment, the access table system 100 may include bar counter units 113 at the diverge sections 202, 204 of the loop 200 to provide services for the guests accommodated in the scale members 120. The bar counter units 113 may incorporate carcasses with integrated adjustable shelving, cabinet doors with soft close mechanisms, counter top for food/drink service, and integrated access steps/ladder, all incorporating built in power outlets; and concealed task lighting. Alternatively, the bar counter units 113 may be used for any other purposes.

Figure 3B:
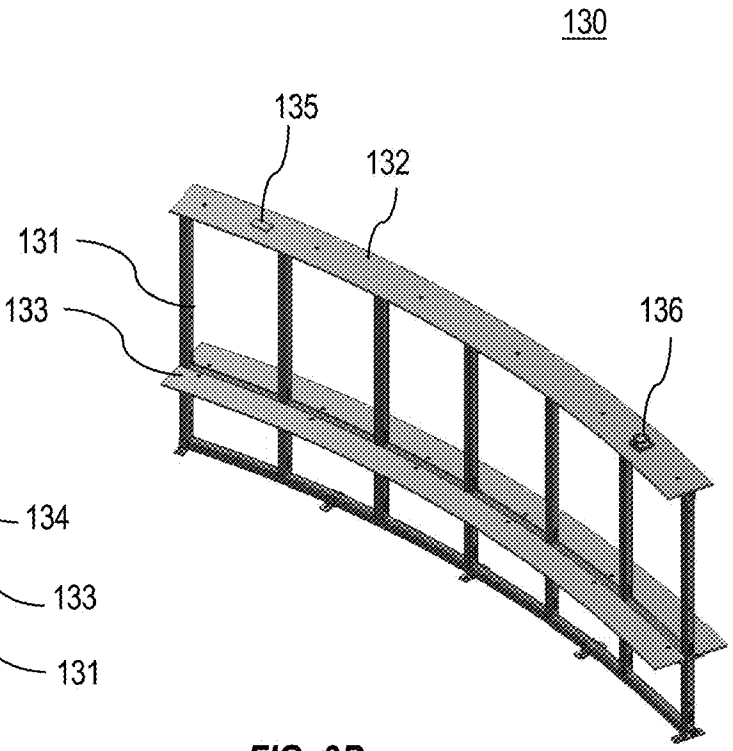
FIGS. 3A-3B show perspective views of a spine.
Figure 3A:
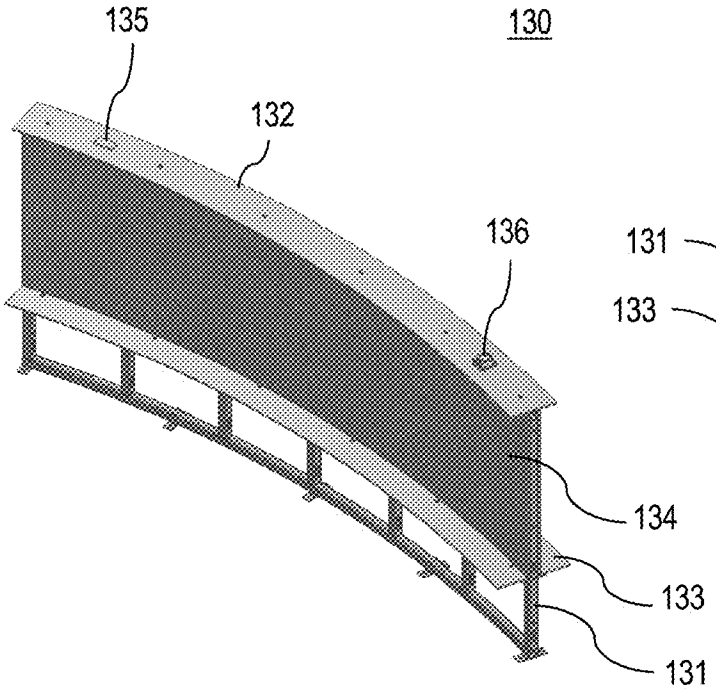
Figure 4A:
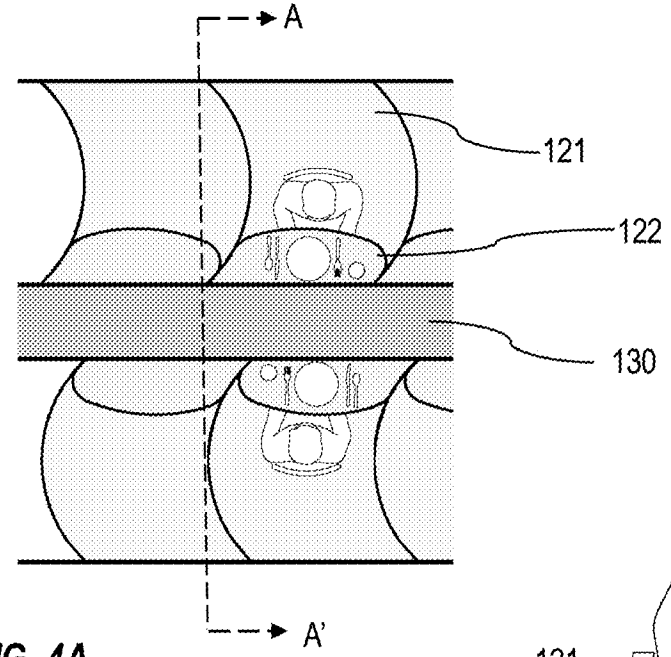
FIG. 4A shows a top view of the spine and the scale members with guests sitting at the scale tables.
Figure 4B:
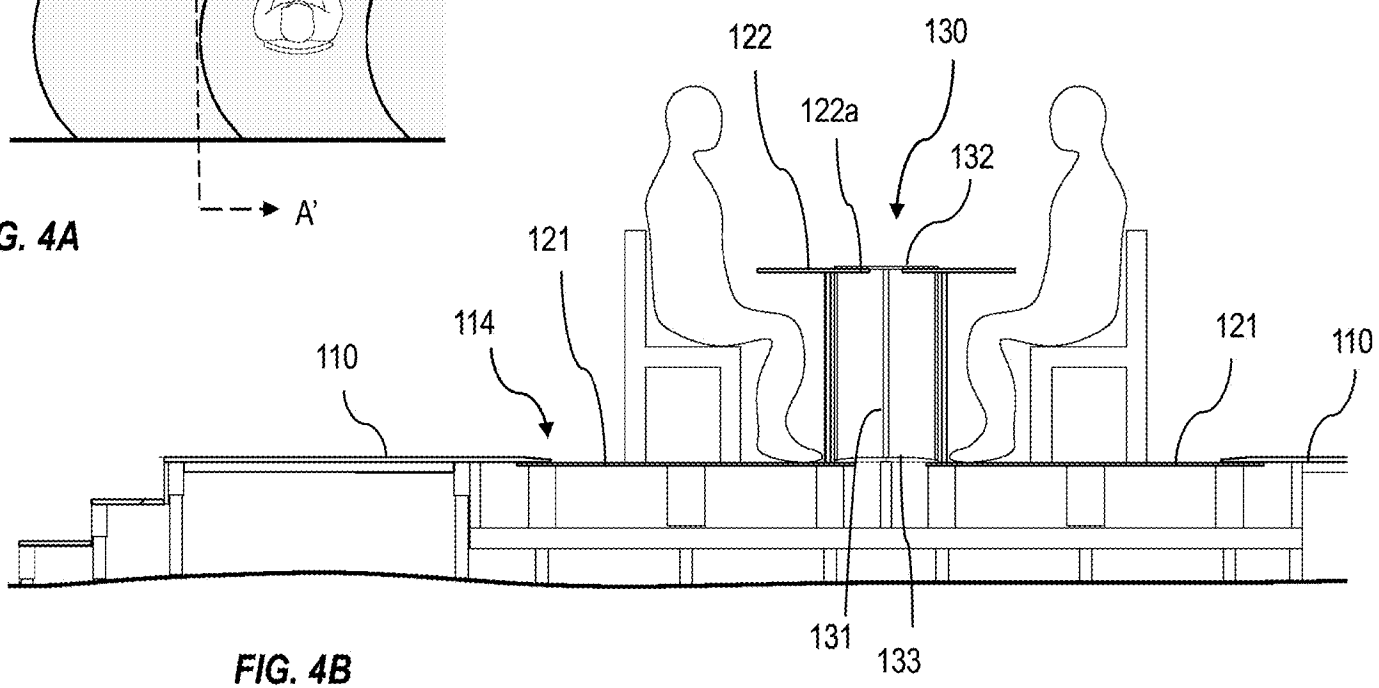
FIG. 4B shows a cross-sectional view cut along the line A-A' of FIG. 4A.

With reference to FIGS. 3A-3B, shown are perspective views of the spine 130. FIG. 3A shows the spine 130 with cladding 134 and FIG. 3B shows the spine 130 without cladding. With reference to FIG. 4A, shown is a top view of the spine 130 and the scale members 120 with guests sitting at the scale tables 122. With reference to FIG. 4B, shown is a cross-sectional view cut along the line A-A' of FIG. 4A. The spine 130 includes a vertical member 131 and a horizontal member at the top portion of the vertical member 131, and may include a base member 133. As shown in FIGS. 3A-4B, the horizontal member 132 is configured to cover inner edge portions 122*a* of the scale tables 122. The vertical member 131 supports the horizontal member 132 and may be fixed to an internal structure of the base deck 110. The base member 133 may cover edge portions of the scale platforms 121. The spine 130 is further configured to include recessed power sockets 135 at regular intervals. The spine 130 may also include emergency stop (E-Stop) 136 to stop movement of the scale members 120 in emergency situations. As shown in FIG. 2, in the parallel sections 201, 203, the spine 130 separates facing scale members 120 in opposite sides, which are moving opposite to each other. In the diverge sections 202, 204, the spine 130 may extend along a side of the scale members 120 and may separate the counter unit 113 from the scale members 120.

Figure 5B:
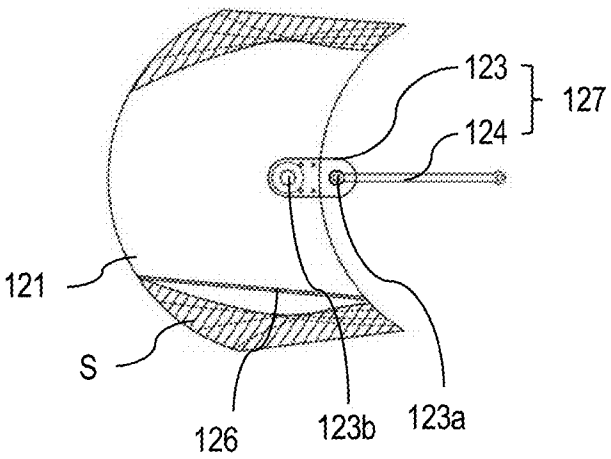
FIG. 5B shows a top view of scale platform and link unit in an embodiment.
Figure 5A:
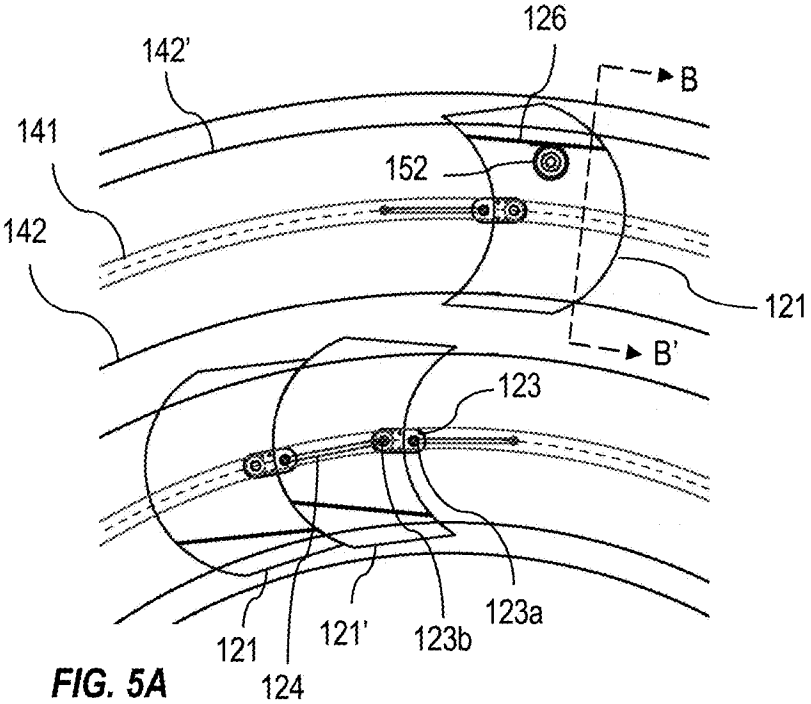
FIG. 5A shows a top view of the scale platform coupled to a track system and a link unit.

With reference to FIG. 5A, shown is a top view of the scale platform 121 coupled to the track system 140 and link unit 127. With reference to FIG. 5B, shown is a top view of scale platform 121 and link assembly 123. Each scale member 120 includes link assembly 123 fixedly mounted on a lower surface 121*a* of the scale platform 121 and linking rod 124 coupled to the link assemblies 123 of adjacent scale platforms. In an embodiment, as shown in FIGS. 5A-5B, the link assembly 123 includes a first axle 123*a* and a second axle 123*b* extending vertically. Linking rod 124 is rotatably coupled to the first axle 123*a* of scale platform 121 and rotatably coupled to the second axle 123*b* of the adjacent scale platform 121'. In this embodiment, the second axle 123*b* is placed under the scale platform 121 while the first axle 123*a* is placed out of the scale platform 121. In this way, multiple scale platforms 121 are connected to each other in a tessellating fashion. The hatched area S shown in FIG. 5B represents an area of the scale platform 121 occluded by floors of the base deck 110.

Figure 5C:
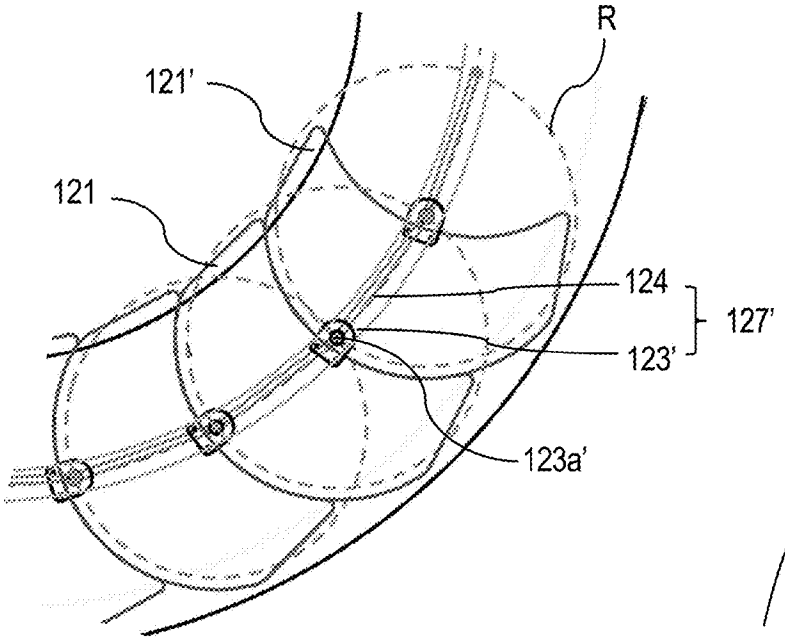
FIG. 5C shows a top view of scale platform and link assembly in another embodiment.

With reference to FIG. 5C, shown is a top view of link unit 127' of another embodiment which includes link assembly 123' fixedly mounted on a lower surface 121*a* of the scale platform and linking rod 124. The difference is that the link assembly 123' has only axle 123*a*' extending vertically. The linking rod 124 is rotatably coupled to the first axle 123*a*' of scale platform 121 and rotatably coupled to the first axle 123*a*' of the adjacent scale platform 121'. The link assembly 123' of FIG. 5C may be used for a smaller size scale platforms while the link assembly 123 shown in FIGS. 5A-5B may be used for a larger size scale platforms. For example, the length between the first axles 123*a*' of neighboring scale platforms of FIG. 5C may be 668 mm, while the length between the first axles 123 of neighboring scale platforms of FIG. 5A May be 850 mm.

Figure 6:
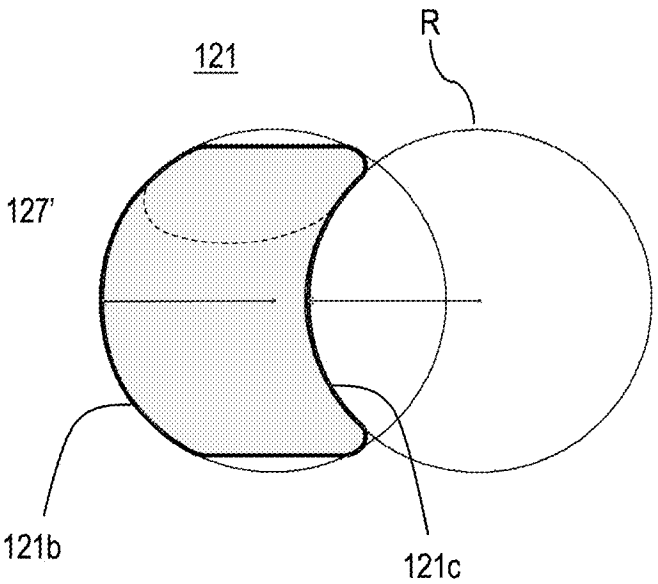
FIG. 6 shows a diagram illustrating the shape of the scale platform that is configured to be tessellated with neighboring scale platforms.

With reference to FIG. 6, shown is a diagram illustrating the shape of the scale platform 121 that is configured to be tessellated with adjacent scale platforms. The scale platform 121 is constructed based on a reference circle R. The scale platform 121 has a first tessellating side 121*b* and second tessellating side 121*c* that are configured to be substantially fit with corresponding tessellating sides of adjacent scale platforms. The first tessellating side 121*b* is formed along the arc of the reference circle R of the scale platform 121, and the second tessellating side 121*c* is formed along the arc of the circle R of the adjacent scale platform. In this way, the scale platforms may be tessellated with each other without noticeable gap between the scale platforms 121 while the scale platforms 121 move along any sections of the guide track 141.

Figure 7:
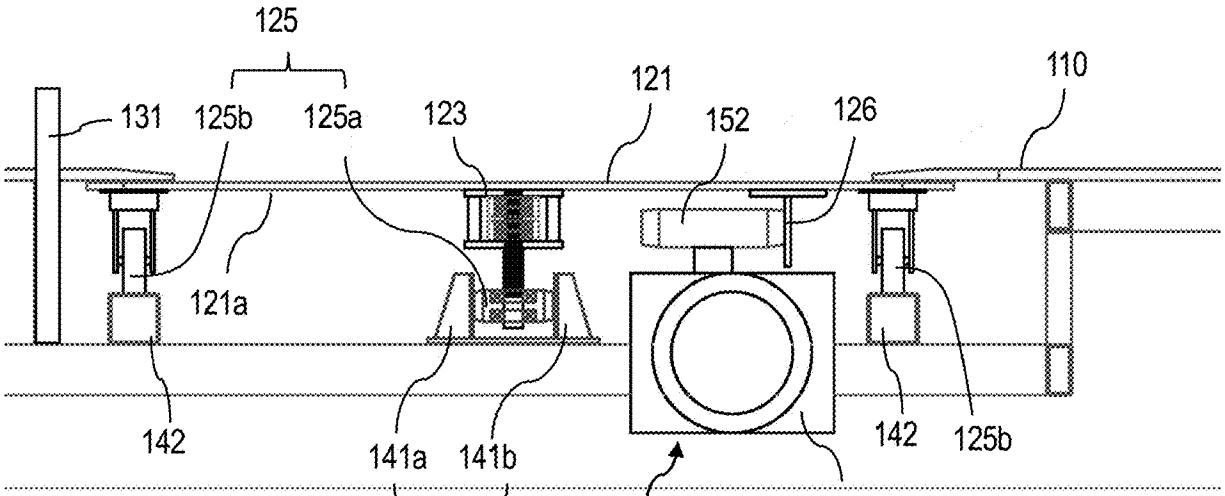
FIG. 7 shows a cross-sectional view cut along the line B-B' of FIG. 5A.

With reference to FIG. 7, shown is a cross-sectional view cut along the line B-B' of FIG. 5A. Each scale member 120 includes wheel system 125 that includes at least one guide wheel 125*a* and one or more support wheels 125*b*. The wheel system 125 is attached to the lower surface 121*a* of the scale platform 121. In an embodiment, the guide track 141 may include two rails 141*a*, 141*b* as shown in FIG. 7, and the guide wheel 125*a* is placed between the rails 141*a* and 141*b* so that the scale members 120 may not deviate from the guide track 141. The rails 141*a*, 141*b* may be constructed in a manner that a gap between the rails 141*a*, 141*b* is slight larger than the diameter of the guide wheel 125*a* so that the guide wheel 125*a* may roll either on the rail 141*a* or rail 141*b* while the scale member 120 is moving. In this configuration, the rails 141*a*, 141*b* not only prevent the guide wheel 125*a* from deviating out of the guide track 141 but also provide flexible and smooth rolling in curved sections of the guide track 140. In the embodiment shown in FIG. 7, the guide wheel 125*a* may be aligned with or installed to the second axle 123*b*. FIG. 7 exemplarily shows two rail configuration of the guide track 141. However, the guide wheel and guide track configuration is not limited to this two rail configuration. Any types or configurations of guide tracks may be employed to smoothly guide the scale members 120 along the guide track 141.

One or more support wheels 125*b* may be placed at portions of the scale platform 121 to stably support the weight of the scale member 120. The support wheels 125*b* are respectively aligned with the support tracks 142 and rolls on the support tracks 142 while the scale member 120 is moving. The locations of the support wheels 125*b* and the support tracks 142 may be determined by considering the weight balance of the scale members 120.

The access table system 100 includes one or more driving mechanisms 150 to drive the scale members 120 in a desired direction. As shown in FIGS. 5A-5B and 7, the driving mechanism 150 includes driving wheel 152 and driving member 151 such as a motor to drive the driving wheel 152. Each scale member 120 includes rack member 126 attached at the lower surface 121*a* of the scale platform 121. The rack member 126 engages with the driving wheel 152 to convert a rotational motion of the driving wheel 152 into a linear motion along the guide track 141. The scale members 120 are driven in a direction by the force exerted to the rack member 126. In an embodiment, the access table system 100 may include multiple driving mechanisms 150 to provide enough power to drive the scale members 120 smoothly.

The driving mechanism 150 is configured to drive the scale members 120 at varied speed depending on the intended utilities of the access table system 100. For example, for the public use such as bar services and ticketing, medium speed such as 0.5-1.0 m/min may be proper. For an event such as formal dinner and food services, slow speed such as 0.25 m/min may be proper. For events such as performance, lecture, and concert events, fast speed such as 2.0 m/min may be proper. For example, if the total length of the track is 88.20 m, it will take about 2 hours 56 minutes to 1 hour 28 minutes to complete one trip of rotation at the medium speed, about 5 hours 53 minutes at the slow speed, and about 44 minutes at the fast speed. These numbers are only examples to demonstrate how the access table system 100 may be controlled for intended purposes. Operators may control the driving mechanism 150 to set proper speed based on the types of events. Moreover, the driving mechanism 150 is configured to reverse the moving direction.

In order to provide high friction between the driving wheel 152 and rack member 126, a contact surface of the driving wheel 152, which contacts the rack member 126, may be coated with a high friction material such as rubber, and the rack member 126 may be a plate which is coated with a high friction material. Alternatively, the driving wheel 152 may be a cog and the rack member 126 may be a gear rack. The access table system 100, however, may employ any types of driving wheels and rack members to provide smooth motions of the scale members 120 without noticeable vibrations, jolts, and noises. FIGS. 5A-5B and 7 show a flat plate shape the rack member 126, but the driving rack 126 is not limited to this shape. FIGS. 5A-5B and 7 exemplarily illustrate that the rack member 126 is placed near one of the support wheels 125*b*. However, the location of the rack member 126 is not limited to this position. The location of the rack member 126 may be adjusted considering balance of overall weight of the scale member 120 which may include weight of guests and additional objects placed in the scale platform 121.

Figure 8:
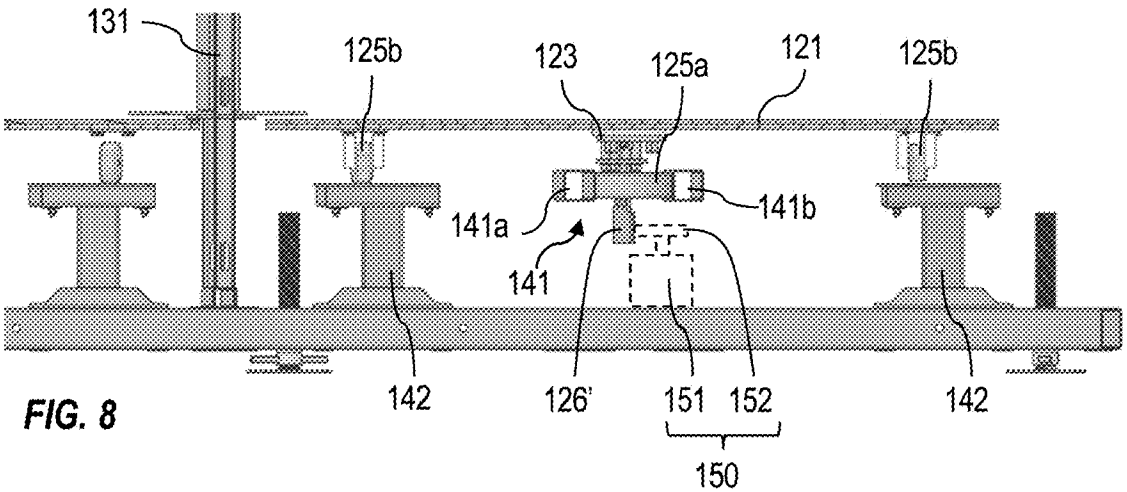
FIG. 8 shows a cross-sectional view of an alternative configurations to drive the scale members.

With reference to FIG. 8, shown is a cross-sectional view of an alternative configurations to drive the scale members 120. The rack member 126' is located around the center portion of the scale platform 121 at lower position than the guide track 141. The driving wheel 152 is also located at lower position than the guide track 141 and engages with the rack member 126'. In an embodiment, the rack member 126' may be formed at a lower portion of the linking rod 124.

Figure 9:
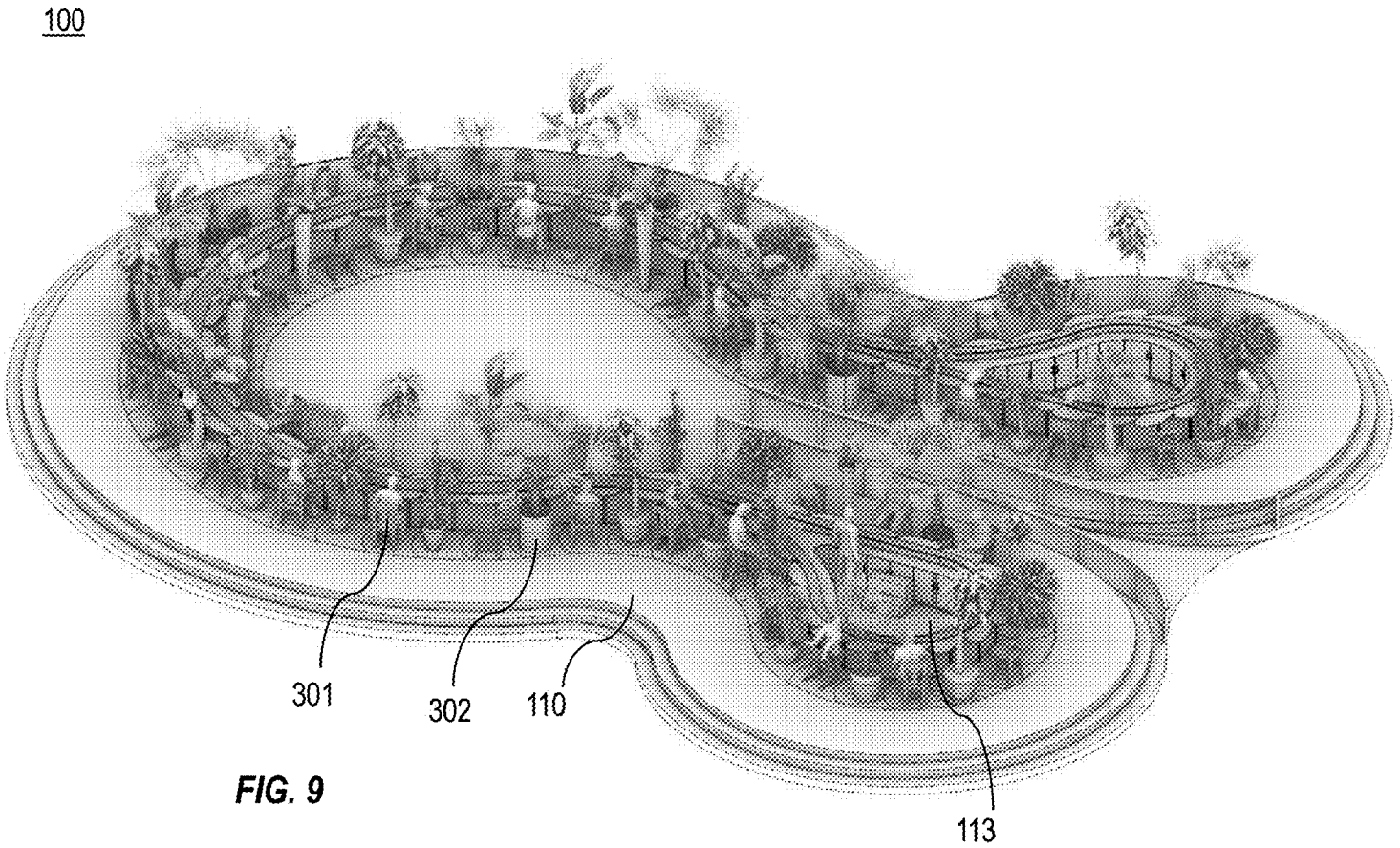
FIG. 9 shows a diagram of an exemplary horseshoe shape access table system in real world applications.

With reference to FIG. 9, shown is a diagram of an exemplary horseshoe shape access table system 100 in real world applications. Guests 301 are sitting at tables and plant pots 302 are placed on the scale platforms.

Since many modifications, variations, and changes in detail can be made to the described preferred embodiments of the invention, it is intended that all matters in the foregoing description and shown in the accompanying drawings be interpreted as illustrative and not in a limiting sense. Consequently, the scope of the invention should be determined by the appended claims and their legal equivalents.

What is claimed is:

1. An access table system, comprising:

a track system including at least one guide track forming a loop, wherein the loop comprises at least one parallel region in which sections of the guide track are aligned substantially in parallel;

a plurality of scale members coupled to the track system, wherein the scale members are connected to each other and are configured to be movable along the guide track, wherein the track system further comprises one or more support tracks configured to support the scale members, wherein each scale member comprises:

a scale platform;

a wheel system that comprises at least one guide wheel configured to be coupled to the at least one guide track, wherein the wheel system comprises one or more support wheels configured to roll on the support tracks; and a link unit configured to link the scale platform to a scale platform of an adjacent scale member;

a spine arranged along the scale members and including a vertical member and a horizontal member formed at a top portion of the vertical member, wherein in the parallel region, the spine is disposed between the scale members that are parallel to each other and are at opposite sides; and at least one driving mechanism configured to drive the scale members along the guide track.

2. The access table system of claim 1 further comprising a base deck covering the track system, wherein the base deck has an opening through which the scale platforms of the scale members are exposed.

3. The access table system of claim 2 wherein the base deck includes a space through which users access the scale platforms.

4. The access table system of claim 2 wherein the loop comprises one or more diverge regions in which the guide track are not in parallel, and the base deck includes one or more counter units in the diverge regions.

5. The access table system of claim 1 wherein the guide track comprises two rails and the guide wheel is placed between the two rails.

6. The access table system of claim 5 wherein a gap between the two rails is larger than a diameter of the guide wheel.

7. The access table system of claim 1 wherein the one or more support tracks include two support rails and the guide track is placed between the two support rails.

8. The access table system of claim 1 wherein the driving mechanism comprises at least one driving wheel and a driving member that drives the driving wheel.

9. The access table system of claim 8 wherein said each scale member comprises a rack member configured to be coupled to the driving wheel of the driving mechanism.

10. The access table system of claim 9 wherein a contact surfaces of the driving wheel and the rack member are coated with high friction materials.

11. The access table system of claim 9 wherein the driving wheel includes a cog and the rack member includes a gear rack.

12. The access table system of claim 9 wherein the driving rack member has a flat plate shape.

13. The access table system of claim 1 wherein the link unit comprises a link assembly mounted on a lower surface of the scale platform.

14. The access table system of claim 13 wherein the link unit further comprises a linking rod connecting the scale platform to a scale platform of the adjacent scale member, wherein the linking rod is rotatably coupled to the link assembly and to a link assembly of the adjacent scale member.

15. The access table system of claim 14 wherein the link assembly further comprises a first axle and a second axle, and the linking rod is configured to be rotatably coupled to the first axle of the scale member and configured to be rotatably coupled to the second axle of the adjacent scale member.

16. The access table system of claim 14 wherein the link assembly further comprises an axle, and the linking rod is configured to be rotatably coupled to the axle of the scale member and to the axle of the adjacent scale member.

17. The access table system of claim 1 wherein the scale members are connected to each other in a tessellating fashion.

18. The access table system of claim 17 wherein said each scale platform has tessellating sides that are tessellated with adjacent scale platforms.

19. The access table system of claim 1 wherein each scale member comprises at least one scale table attached to the scale platform.

20. The access table system of claim 19 wherein the horizontal member is configured to cover edge portions of both scale tables of the scale members that are parallel to each other and are at opposite sides.

* * * * *